US010302052B2

(12) United States Patent
Arteaga et al.

(10) Patent No.: US 10,302,052 B2
(45) **Date of Patent: *May 28, 2019**

(54) VACUUM ACTUATED MULTI-FREQUENCY QUARTER-WAVE RESONATOR FOR AN INTERNAL COMBUSTION ENGINE

(71) Applicant: Ford Global Technologies, LLC, Dearborn, MI (US)

(72) Inventors: Jose Arteaga, Dearborn, MI (US); Suman Mishra, Canton, MI (US); Muhammad Umar Farooq, Farmington Hills, MI (US)

(73) Assignee: FORD GLOBAL TECHNOLOGIES, LLC, Dearborn, MI (US)

( * ) Notice: Subject to any disclaimer, the term of this patent is extended or adjusted under 35 U.S.C. 154(b) by 8 days.

This patent is subject to a terminal disclaimer.

(21) Appl. No.: 15/353,459

(22) Filed: Nov. 16, 2016

(65) Prior Publication Data

US 2018/0135573 A1 May 17, 2018

(51) Int. Cl.
*F02M 35/12* (2006.01)

(52) U.S. Cl.
CPC .... *F02M 35/1222* (2013.01); *F02M 35/1261* (2013.01); *F02M 35/1294* (2013.01)

(58) Field of Classification Search
CPC ..... F02M 35/1222; F02M 35/1261; F02M 35/1294
USPC ..... 181/214, 229, 226
See application file for complete search history.

(56) References Cited

U.S. PATENT DOCUMENTS

| | | | |
|---|---|---|---|
| 1,173,583 | A | 2/1916 | Johnston et al. |
| 1,375,621 | A | 4/1921 | Wright, Jr. |
| 1,495,690 | A | 5/1924 | Hayes |
| 1,975,483 | A | 10/1934 | Semple |
| 2,404,589 | A | 7/1946 | Monaghan |
| 3,254,484 | A | 6/1966 | John |
| 3,620,330 | A | 11/1971 | Hall |
| 3,726,092 | A | 4/1973 | Raczuk |

(Continued)

FOREIGN PATENT DOCUMENTS

| | | | |
|---|---|---|---|
| EP | 0649982 | A1 | 12/1996 |
| JP | 02215925 | A | 8/1990 |

(Continued)

*Primary Examiner* — Forrest M Phillips
(74) *Attorney, Agent, or Firm* — Julia Voutryas; Brooks Kushman, P.C.

(57) ABSTRACT

A variable noise attenuation element includes at least two tube sections that define an overall tube length that defines a first effective length and associated first peak frequency for noise attenuation, and a valve having a valve member. The valve joins the tube sections together and includes openings that permit communication between the tube sections when the valve is in an open configuration. The valve member operates to close the opening in response to a predetermined vacuum level within the tube sections to define a second tube effective length and associated second peak frequency for attenuation that is less than the overall length. A method of attenuating noise in a vehicle using a passive attenuation arrangement operates a valve disposed between two tube sections to change an effective length of the tube and associated peak frequencies for attenuation in response to an engine operating parameter.

9 Claims, 11 Drawing Sheets

(56) References Cited

U.S. PATENT DOCUMENTS 4,484,659 A 11/1984 Buchwalder
4,562,809 A 1/1986 Sausner et al.
5,137,439 A 8/1992 Lundin
5,246,205 A 9/1993 Gillingham et al.
5,317,112 A * 5/1994 Lee ..... F02M 35/1255 181/250
5,333,576 A * 8/1994 Verkleeren ..... B60K 13/02 123/184.53
5,435,347 A 7/1995 Gillingham
6,382,161 B1 5/2002 Alex et al.
6,494,290 B1 12/2002 Jessberger
6,622,486 B2 9/2003 Jarvi
6,792,907 B1 * 9/2004 Kostun ..... F01N 1/02 123/184.57
6,848,410 B2 2/2005 Hoffmann
7,448,353 B2 * 11/2008 Shinada ..... F02M 35/04 123/184.53
7,779,962 B2 * 8/2010 Zhang ..... F01N 1/163 181/226
7,934,581 B2 * 5/2011 Kim ..... F04D 29/665 123/184.53
8,327,975 B2 * 12/2012 Ortman ..... F02B 33/44 123/184.53
8,485,311 B2 * 7/2013 Mackenzie ..... F02M 35/10137 123/184.21
8,528,692 B2 * 9/2013 Teshima ..... F02M 35/10144 123/184.53
9,394,864 B2 * 7/2016 Arteaga ..... F02M 35/1261
9,726,125 B2 8/2017 Arteaga et al.
2002/0005318 A1 1/2002 Schumacher et al.
2002/0100281 A1 8/2002 Hellat
2008/0156579 A1 * 7/2008 Hayashi ..... F02M 35/1272 181/229
2009/0229913 A1 9/2009 Tonietto et al.
2010/0193282 A1 * 8/2010 Kim ..... F04D 29/665 181/229
2014/0316325 A1 10/2014 Jaber
2015/0361934 A1 * 12/2015 Arteaga ..... F02M 35/1261 181/229
2016/0230719 A1 * 8/2016 Kato ..... F02M 35/1261

FOREIGN PATENT DOCUMENTS

JP 2006308257 A 11/2006
WO 2004094826 A1 11/2004

* cited by examiner

VACUUM ACTUATED MULTI-FREQUENCY QUARTER-WAVE RESONATOR FOR AN INTERNAL COMBUSTION ENGINE

TECHNICAL FIELD

The present disclosure is directed to a noise attenuation device that has an effective length that may be selectively varied by a vacuum actuator.

BACKGROUND

Internal combustion engines produce undesirable induction noise within a vehicle. While the induction noise is dependent on the particular engine configuration and other induction system parameters, such noise is caused by a pressure wave that travels toward the inlet of the air induction system. Induction noise is particularly problematic in hybrid vehicles, as changes in ambient noise are particularly noticeable, because engines in hybrid vehicles repeatedly turn on and off. Moreover, hybrids tend to operate a specific engine RPMs that maximize efficiency since the engine speed is not directly related to vehicle speed and can be varied by changing the generator speed (depending on the powertrain architecture).

To address such noise, it is known to utilize exhaust mufflers to reduce engine exhaust noise, as well as smooth exhaust-gas pulsations. Some known mufflers include a series of fixed expansion or resonance chambers of varying lengths, connected together by pipes. With this configuration, the exhaust noise reduction is achieved by the size and shape for the individual fixed expansion chambers. While increasing the number of channels can further reduce exhaust noise, such configurations require additional packaging room within the vehicle, limiting design options for various components. Further, while mufflers traditionally include sound deadening material, such material only dampens sounds over a broad narrow of higher frequencies.

Another proposed solution for addressing undesirable noise is use of a Helmholz resonator or a quarter-wave resonator. These resonators produce a pressure wave that counteracts primary engine order noise waves. Such resonators consist of a fixed volume chamber connected to an induction system duct by a connection or neck. However, such arrangements attenuate noise only at a fixed narrow frequency range.

However, the frequency associated with the primary order of engine noise is different at different operating levels. Thus a fixed geometry resonator would be ineffective in attenuating primary order noise over much of the complete range of engine speeds encountered during normal operation of a vehicle powered by the engine. Moreover, such conventional resonator systems provide an attenuation profile that does not match the profile of the noise and yields unwanted accompanying side band amplification. This is particularly true for a wide band noise peak. The result is that when a peak value is reduced to the noise level target line at a given engine speed, the amplitudes of noise at adjacent speeds are higher than the target line. While multiple resonators could be used to address different frequencies, such a solution requires additional packaging room within a vehicle.

While not as common as the passive devices described above, active noise cancellation systems have also been employed in vehicle exhaust systems. Active noise cancellation systems include one or more vibrating panels (i.e., speakers) that are driven by a microprocessor. The microprocessor monitors the engine operation and/or the acoustic frequencies propagating in the exhaust pipe and activates the panels to generate sound that is out-of-phase with the noise generated by the engine to minimize or cancel engine noise. The principle is similar to that used by noise-canceling headphones. However, active devices have significant drawbacks. Some active devices are positioned within a cab of a vehicle and thus require sufficient packaging room for positioning, while maintaining an aesthetics. Other active devices have been placed in the automotive exhaust systems. However, in these arrangements, the microphones and speakers must be more powerful and capable of withstanding the intense heat and corrosive environment of an automobile exhaust. Furthermore, active devices are often cost-prohibitive for many vehicles.

A noise attenuation device that is capable of variable frequency noise reduction is needed.

SUMMARY

In a first exemplary arrangement, a vehicle noise attenuation element is provided that comprises at least two tube sections that define an overall tube length, and a valve having a valve member. The valve joins the tube sections together and includes an opening that permits communication between the tube sections when the valve is in an open configuration. The valve member closes the opening in response to a predetermined vacuum level through the tube sections to define a tube effective length that is less than the overall length.

In a second exemplary arrangement, a noise attenuation element for vehicles is provided that comprises a tube unit defined by a plurality of tube sections, a first valve and a second valve. The tube unit has an overall length that defines a first effective length. The first valve is disposed between first and second tube sections and is defined by a first outer casing, and a first valve member. The first outer casing has at least one first opening that permits communication between the first and second tube sections when the first valve is in an open configuration. The second valve is disposed between the second tube section and a third tube section, and is defined by a second outer casing and a second valve member. The second outer casing has at least one second opening that permits communication between the second and third tube sections when the second valve is in an open configuration. A first vacuum level through the tube unit serves to draw the first valve member against the first openings to move the first valve member into a closed configuration, selectively defining a second effective length of the tube that is less than the first effective length.

An exemplary method of selectively attenuating noise in a vehicle is also disclosed. The method comprises selectively varying an effective length of a quarter-wave tube in response to an engine operating parameter by moving a valve from an open configuration to a closed configuration using a passive actuation system.

DETAILED DESCRIPTION

As required, detailed embodiments of the present invention are disclosed herein; however, it is to be understood that the disclosed embodiments are merely exemplary of the invention that may be embodied in various and alternative forms. The Figures are not necessarily to scale; some features may be exaggerated or minimized to show details of particular components. Therefore, specific structural and functional details disclosed herein are not to be interpreted as limiting, but merely as a representative basis for teaching one skilled in the art to variously employ the present invention.

The present disclosure is directed to a noise attenuation element that utilizes quarter-wave tube sections, joined together to form a quarter-wave tube unit for noise attenuation. A first end of the quarter-wave tube unit is open and in fluid communication with an air intake passage or the like, while the second end is generally closed. Typically, the quarter-wave tube unit will attenuate noise at a given frequency range, due to its fixed geometry. However, lengthening or shortening the length of the quarter-wave tube unit can serve to attenuate noise at a lower or higher frequency range, respectively. Arrangements of a quarter-wave tube unit are disclosed herein, including a quarter-wave tube unit that may be selectively designed with a fixed overall length, but also provided with multiple effective lengths by one or more valve arrangements mounted between adjacent tube sections. This configuration provides for a noise attenuation element that can be tuned to several different frequencies, but only requires packaging space within a vehicle for a single resonator.

Figure 1:
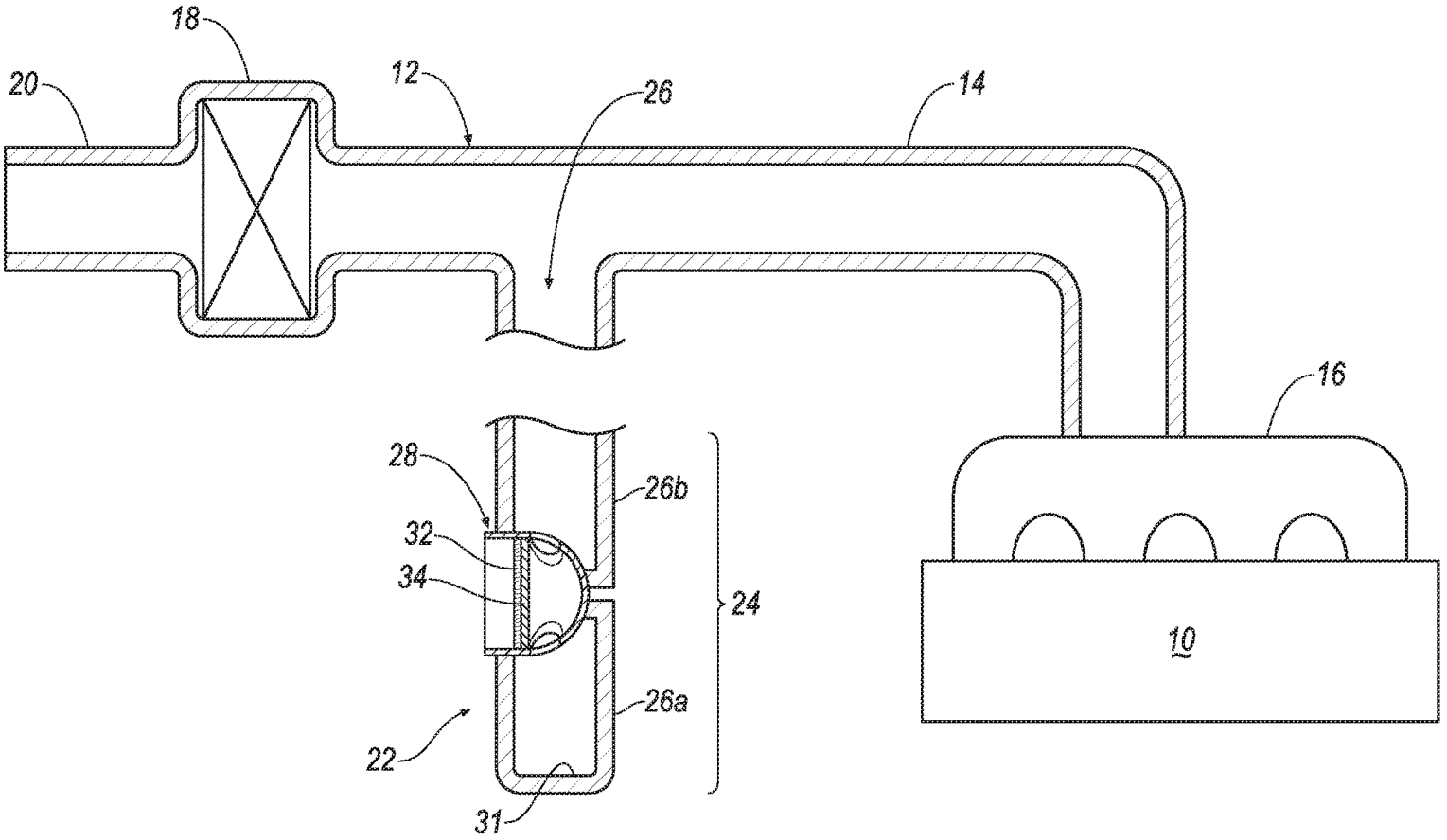
FIG. 1 is a section view of an exemplary air induction system for an internal combustion engine, comprising a first exemplary arrangement of a noise attenuation element.
Figure 2:
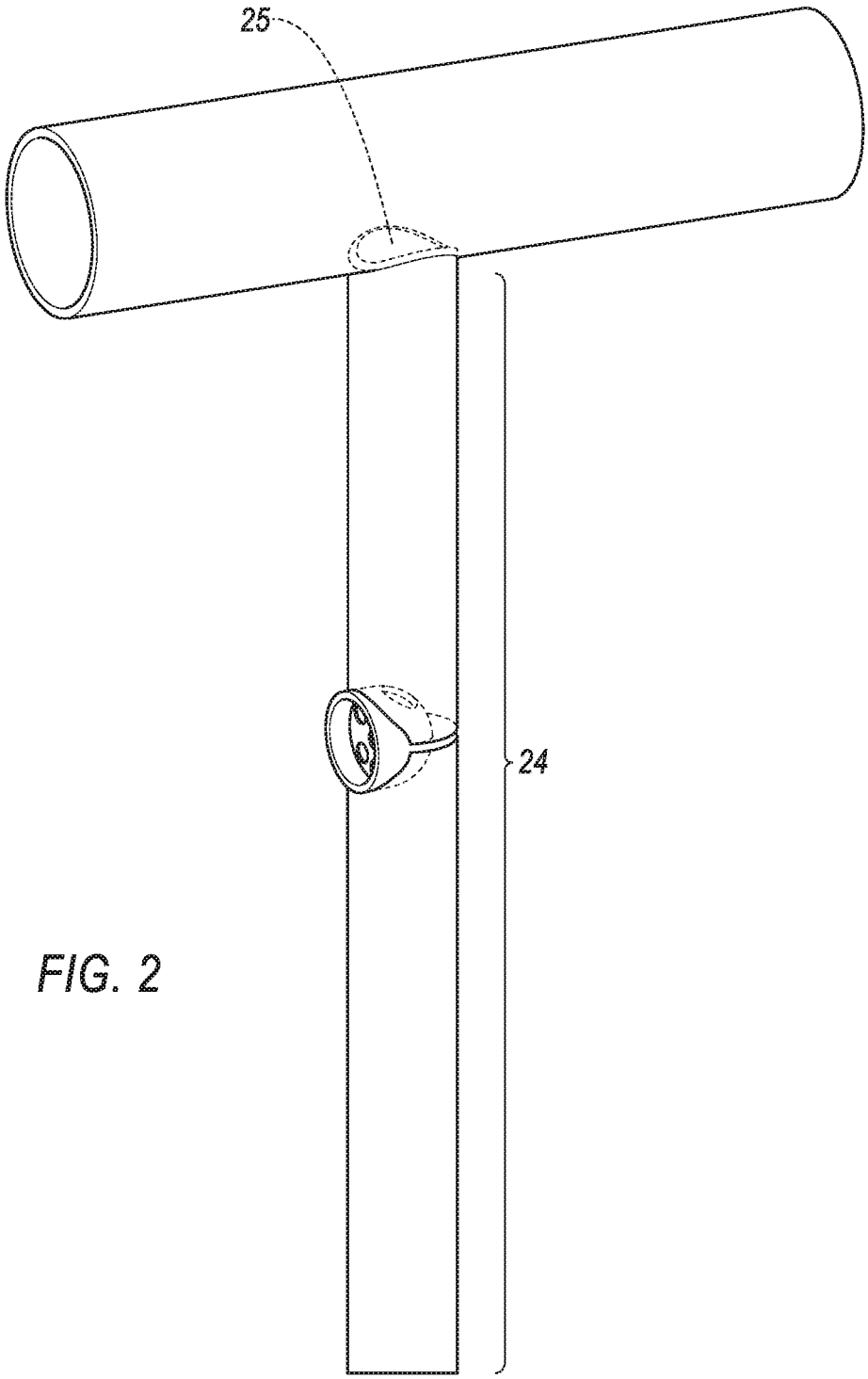
FIG. 2 is an enlarged schematic view of the noise attenuation element of FIG. 1, illustrating valves disposed in the noise attenuation element.

Referring to FIG. 1, an internal combustion engine 10 and an associated air induction system 12 are illustrated. The air induction system 12 comprises an intake passage 14 that is in communication with an engine intake manifold 16. An air cleaner 18 may be in fluid communication with the atmosphere via an intake passage 20. In one exemplary arrangement, a noise attenuation element 22 extends from the air intake passage 14, between the air cleaner 18 and the engine intake manifold 16. Alternatively, the noise attenuation element 22 may be located upstream of the air cleaner 18.

The noise attenuation element 22 comprises a quarter-wave tube unit 24 comprising at least two tube sections 26*a*, 26*b*, that may be selectively joined together by a diaphragm valve 28. The quarter-wave tube unit 24 is defined by an open end 25 (shown in FIG. 1) that is in communication with the air intake passage 14. At least one diaphragm valve 28 is disposed within the quarter-wave tube unit 24, at a predetermined location, between adjacent tube sections 26*a*, 26*b*. For example, a section of the side walls 27*a* and 27*b* of adjoining tube sections 26*a*, 26*b* are removed, and a valve body 28 is disposed within the removed section, as best seen in FIGS. 3A-4B. Each tube section 26*a*, 26*b* further includes a land area 29*a*, 29*b* that closes the area of tube sections 26*a*, 26*b* that are not intersected by the valve body 28. The end 31 of the tube section 26*a* is closed.

Figure 3A:
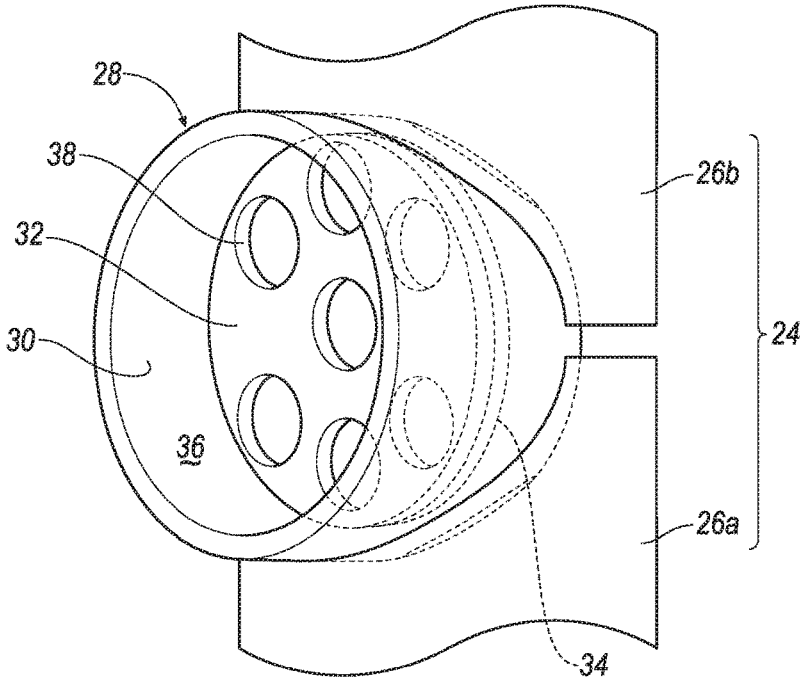
FIG. 3A is a perspective view of an exemplary diaphragm valve in an open position, that may be used in the noise attenuation element.
Figure 3B:
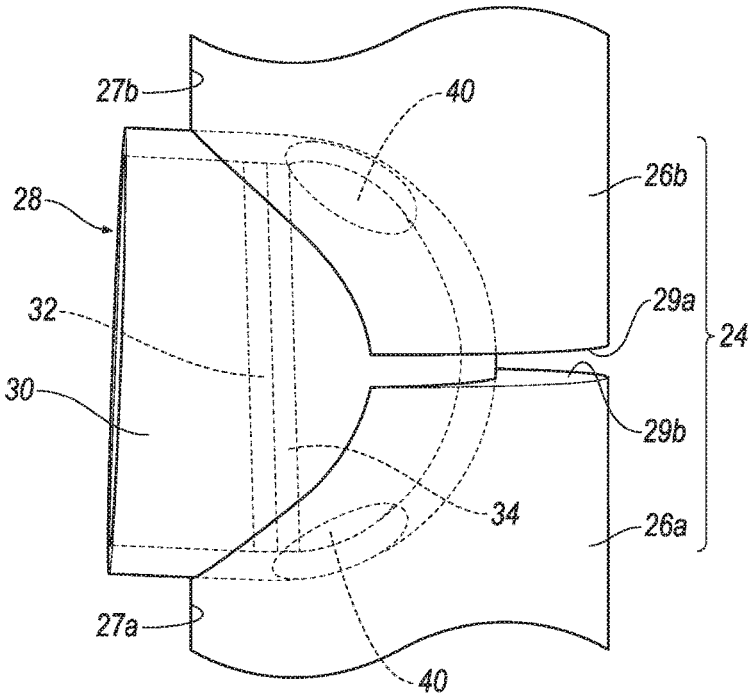
FIG. 3B is a side view of the diaphragm valve of FIG. 3A in the open position.
Figure 4A:
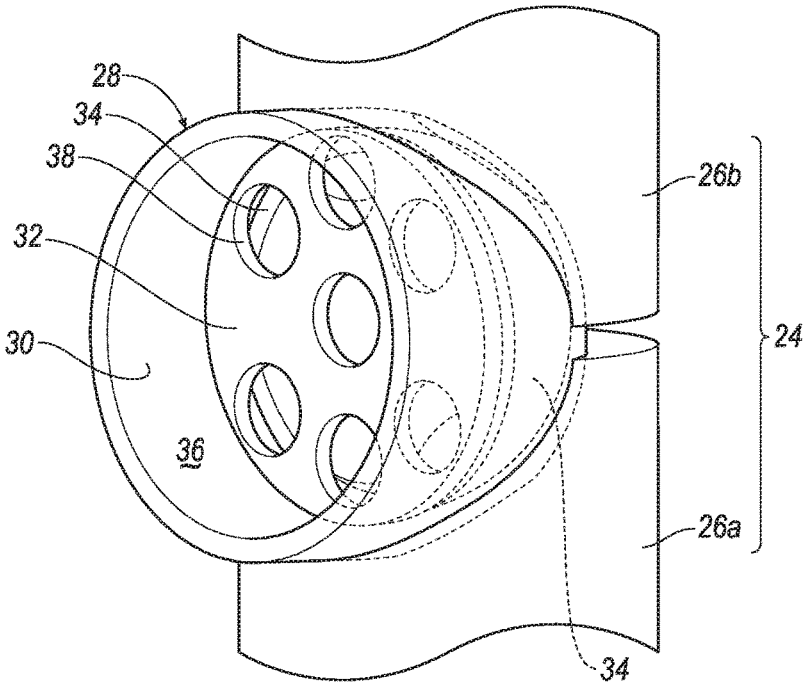
FIG. 4A is a perspective view of the diaphragm valve of FIG. 3A in a closed position.
Figure 4B:
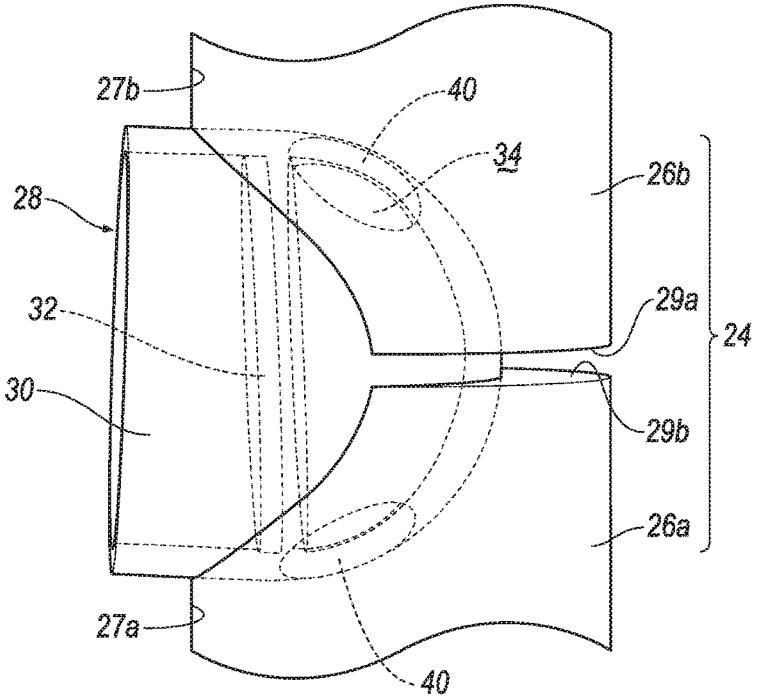
FIG. 4B is a side view of the diaphragm valve of FIG. 3A in the closed position.

Referring to FIGS. 3A-4B, details of the diaphragm valves 28 will now be described. Each valve 28 comprises an outer casing 30, a valve cover 32, and a selectively deformable valve member 34. The valve members 34 of each valve 28 have different spring factor coefficients, as well be explained in further detail below. The outer casing 30 is generally hollow and receives the valve cover 32 and valve member 34 therein. The valve cover 32 is fixedly connected to the inner wall 36 of the outer casing 30. The valve cover 32 includes vent openings 38 therethrough. The outer casing 30 further comprises openings 40 therethrough that allow communication between adjoining tube sections 26*a*, 26*b* when the valve body 28 is in an open configuration as shown in FIGS. 3A and 3B. When the valve body 28 is in a closed configuration (as shown in FIGS. 4A and 4B), no communication is permitted between adjoining tube sections 26*a*, 26*b*.

In operation, with the engine 10 either not operating, or operating at a low operation condition (for example, idling), the valve 28 is in the open configuration shown in FIGS. 3A and 3B. The openings 40 through the outer casing 30 provide communication from the open end 25 of the quarter wave tube unit 24 to the closed end 31 (as shown in FIG. 1), such that a first effective length of the quarter wave tube unit 24 is equal to the overall length of the quarter wave tube unit 24. At the first effective length, the noise attenuation element 22 will attenuate noise within a first predetermined frequency range or band. It will be appreciated that the first predetermined frequency level can be determined based on the known geometry of the quarter-wave tube 24. The valve cover 32 serves as a stop to prevent the valve member 34 from blowing out of the valve 28.

When the engine 10 operational conditions change, i.e., when engine speed increases, more air and fuel is required. The increase in air flow in the clean side duct, not only will trigger a change in noise frequency levels, it will also increase the vacuum in the system. The valve member 34 is constructed with a predetermined spring factor coefficient so as to be calibrated to close the valve at a certain vacuum point, dependent upon the operational conditions of the engine. Closing the valve 28 will vary the effective length of the quarter wave tube unit 24, without requiring any sensors or a control system.

More specifically, when the engine speed increases to a certain initial threshold level, the vacuum generated by the increase in air flow will cause the valve member 34 in valve 28 to be drawn against an inside surface of the outer casing 30, covering the openings 40, so as to put the valve 28 in a closed configuration as shown in FIGS. 4A-4B. In this manner, a second effective length of the quarter-wave tube unit 24 is achieved. The second effective length is less than the first effective length. Thus, at the second effective length, the quarter-wave tube unit 24 will attenuate noise within a second predetermined frequency range or band. Because the second effective length is less than the first effective length, the second predetermined frequency range or band will be a higher frequency than the first predetermined frequency. The noise attenuation device 22 therefore may be selectively passively operated to attenuate at two different peak frequencies, but only using a single quarter-wave tube 24 and without requiring any sensors or other active control system. This configuration permits packaging a low frequency long quarter-wave tube, but providing the ability to selectively tune the quarter-wave tube to attenuate higher frequencies by reducing the effective length, without any need for additional packaging space.

Figure 5:
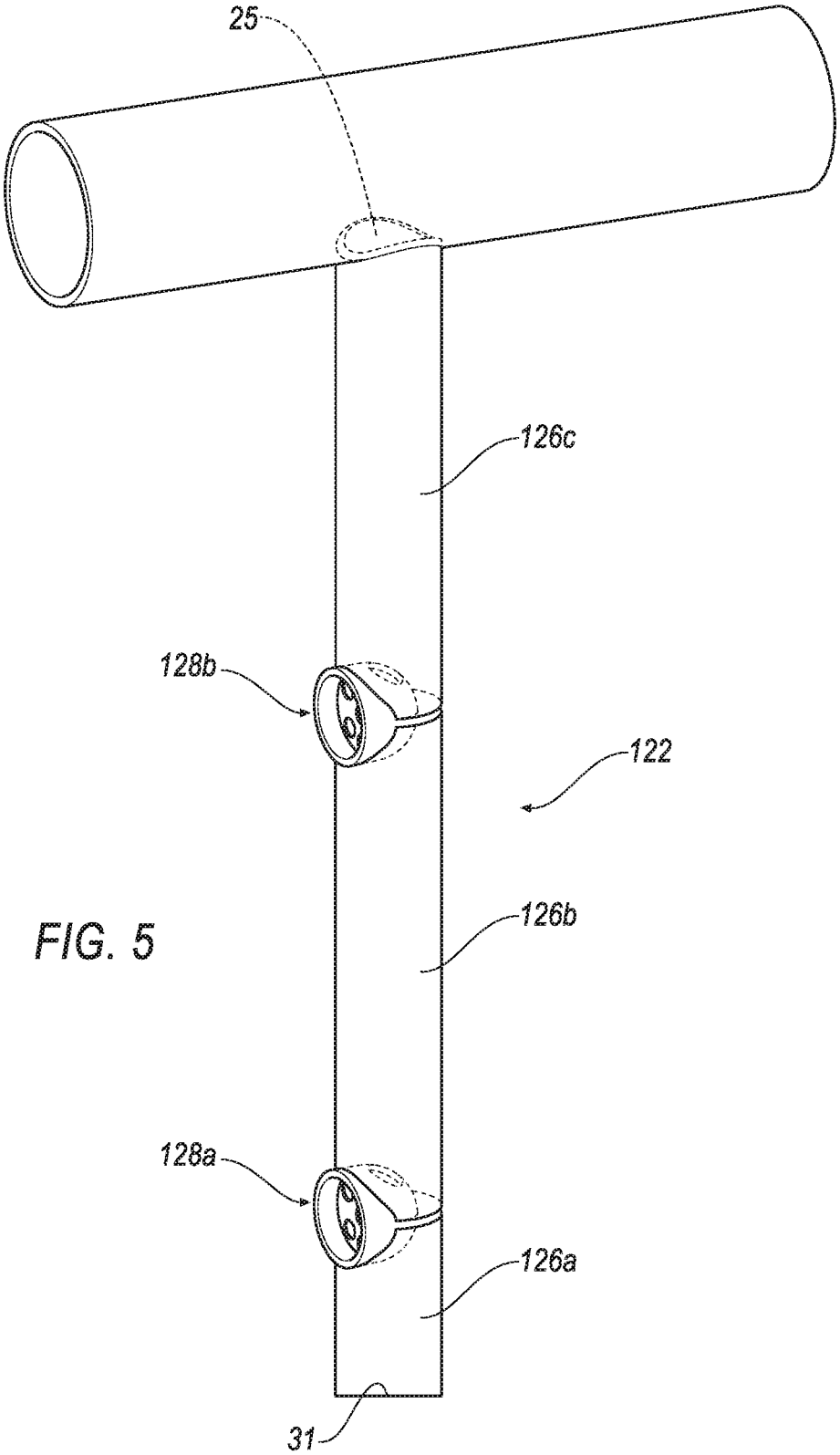
FIG. 5 is a schematic section view of a second exemplary arrangement of a noise attenuation element.

Referring to FIG. 5, an additional arrangement of a noise attenuation device 122 is illustrated. Noise attenuation device 122 is similar to noise attenuation device 22 except that noise attenuation device 122 includes two or more valves. With this arrangement, more than two peak frequencies and associated frequency ranges or bandwidth may be attenuated using a single quarter-wave tube unit 124. In general, the number of peak frequencies attenuated, "n" will match the number of tube sections provided by "n−1" vacuum-actuated valves.

In one exemplary arrangement, noise attenuation device 122 comprises a first valve 128*a* and a second valve 128*b*, each having the same construction as valve 28 (i.e., valve member 34, valve cover 32, openings 40). For ease of illustrations, the valve member, valve cover and openings of the first and second valve 128*a*, 128*b* will be referred to by the appropriate letter designation. For example, valve member 34*a* is disposed within the first valve member 128*a*. The first valve member 34*a* of the first valve 128*a* has a first spring factor coefficient K1, and the second valve 128*b* includes a second valve member 34*b* having a second spring factor coefficient K2 that is higher than the first spring factor coefficient K1. The noise attenuation device 122 further comprises a plurality of tube sections 126*a*, 126*b*, and 126*c*. First valve 128*a* joins first and second tube sections 126*a* and 126*b* together. Second valve 128*b* joins second and third tube sections 126*b* and 126*c*.

Figure 6A:
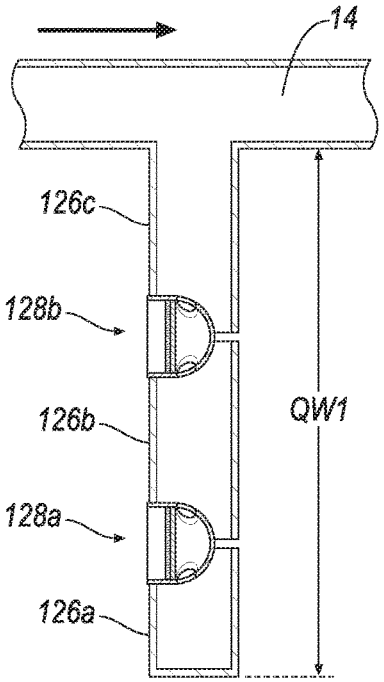
FIGS. 6A-6C are schematic sectional views of the noise attenuation element at various positions during operation of a vehicle.

In a fully open position (as shown in FIG. 6A), the first valve body 128*a* is in the open configuration allowing communication between first and second tube sections 126*a* and 126*b*. Similarly, the second valve body 128*b* is also in the open configuration allowing communication between the second and third tube sections 126*b* and 126*c*.

Figure 6B:
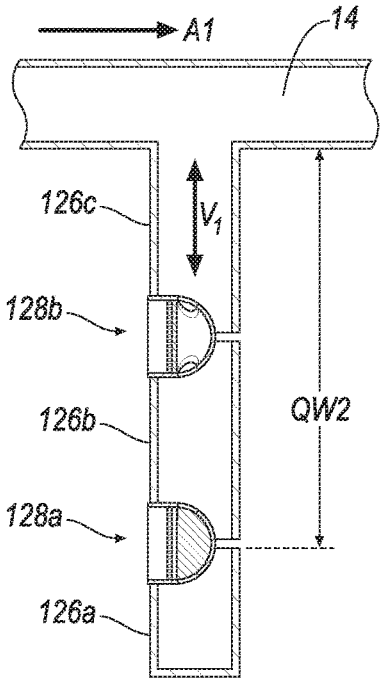

Each of the valve members disposed within the first and second valves 128*a*, 128*b*, respectively have different spring factor coefficients. With this arrangement, the valve members of each of the first and second valves 128*a*, 128*b* will deflect at different vacuum points. More specifically, the valve member 34*a* of the first valve 128*a* has a first spring factor coefficient K1. The valve member 34*b* of the second valve 128*b* has a second spring factor coefficient K2 that is greater than the first spring constant K1. With this arrangement, the valve member 34*b* of the second valve 128*b* will be positioned away from the openings 40*b* of the valve casing 30*b* of the second valve 128*b*, such that fluid communication is possible between second and third tube sections 126*b* and 126*c*, respectively, when the valve member 34*a* of the first valve 128*a* is in a closed configuration, i.e., the valve member 34*a* is drawn against the openings 40*a*, as shown in FIG. 6B, for example. The relationship of the spring factor coefficients for the valve members 34*a*, 34*b*, respectively, can be expressed as follows:

$$K1<K2$$

In operation, with the engine 10 either not operating, or operating at a low operational condition (for example, idling), the first and second valves 128*a*, 128*b* are both in their open configuration, such that the respective valve members 34*a*, 34*b* are not covering the openings 40, of the outer casings 30*a*, 30*b*. In this manner, the first effective length QW1 of the quarter-wave tube unit 124 is equal to the overall length of the quarter-wave tube unit 124 (best seen in FIG. 6A). At the first effective length QW1, the noise attenuation element 122 will attenuate noise at a first predetermined peak frequency. It will be appreciated that the first predetermined peak frequency can be determined based on the known geometry of the quarter-wave tube 124. However, when the first and second valves 128*a*, 128*b* are in their respective closed positions, the effective length of the noise attenuation element 122 can be selectively reduced to second and third effective lengths, QW2-QW3, as demonstrated in FIGS. 6B-6C, respectively. As may be seen, the second effective length QW2 is less than the first effective length QW1, and the third effective length QW3 is less than the second effective length QW2. With this configuration, low frequencies can be attenuated at the first effective length QW1, while successively higher frequencies can be attenuated at the second and third effective lengths QW2-QW3, as will be explained in further detail below. With this arrangement, the noise attenuation device 122 may be selectively passively operated to attenuate at variable peak frequencies, but only using a single quarter-wave tube unit 124, eliminating the need for additional packaging space.

Figure 6C:
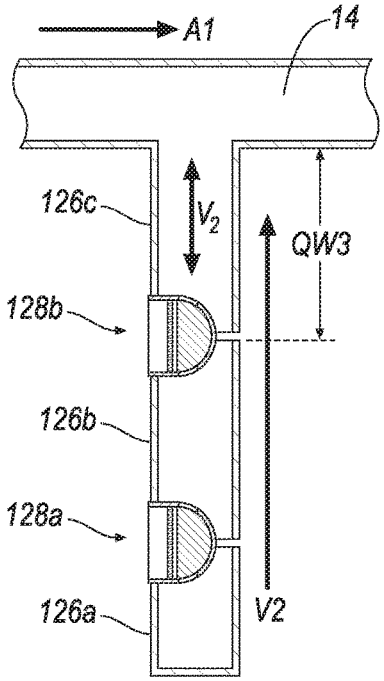

FIGS. 6A-6C demonstrate how the effective length of the quarter-wave tube unit 124 can be selectively varied to attenuate different frequencies. More specifically, FIG. 6A illustrates the noise attenuation element 122 with both of the valves in the open configuration, such that the first effective length QW1 is equal to the overall length of the quarter-wave tube 124. In this position, the engine is either not operating or is operating at a low speed such that little air (represented by arrow A) is moving through the intake passage 14. In this arrangement, little, if any, vacuum force is being exerted against valves 128*a*, 128*b*. In FIG. 6B, a change in operational conditions, whereby the RPM increases, causes a moderate amount of air flow (represented by arrow A1) to move through the intake passage 14. The resulting vacuum force V1 generated in the quarter-wave tube unit 124 overcomes the spring force associated with spring factor coefficient K1 of the valve member 34*a* of first valve 128*a*. In this manner, the valve member 34 will be drawn against the openings 40 of the outer casing 30*a*, moving the first valve 128*a* into the closed configuration. Once the first valve 128*a* is in the closed configuration, the communication between the first and second tube sections 126*a*, 126*b* is closed off, such that the quarter-wave tube unit 124 is reduced to the second effective length QW2. Because the spring factor coefficient K1 for the valve member 34*a* of the first valve 128*a* is less than the spring coefficient K2 for the second valve member 34*b*, the second valve member 34*b* remains open until a second predetermined vacuum force overcomes the associated spring force.

Referring to FIG. 6C, as the engines RPMs continue to increase, air flow (A2) further increases in the intake passage 14, generating a greater vacuum V2 (i.e., V2>V1) in the quarter-wave tube unit 124. At a predetermined vacuum pressure V2, the spring factor coefficient K2 for valve member 34*b* of the second valve 128*b* will be overcome, thereby moving the second valve 128*b* into the closed configuration. With this arrangement, the quarter-wave tube unit 124 is reduced to the third effective length QW3.

The above system provides a passive actuation system for selectively adjusting the effective length of the quarter-wave tube unit 124, but without requiring electronic control by the engine. Indeed, the present arrangement packages a single quarter-wave tube unit 124 that is capable of attenuating multiple peak frequencies as opposed to needing to provide multiple quarter-wave tubes engineered for individual peak frequencies. Moreover, the present arrangement also allows for the frequencies of the quarter-wave tube unit to be selectively changed to avoid undesired side bands.

The above system also allows for different tube segments or sections to be utilized, as well as allows for selective adjustment of the addition or subtraction of tube segments. More specifically, the present system is a modular unit that allows different sized tube segments or sections to be selectively paired with valves 128*a*, 128*b* for different vehicle models or applications, for example.

Figure 7:
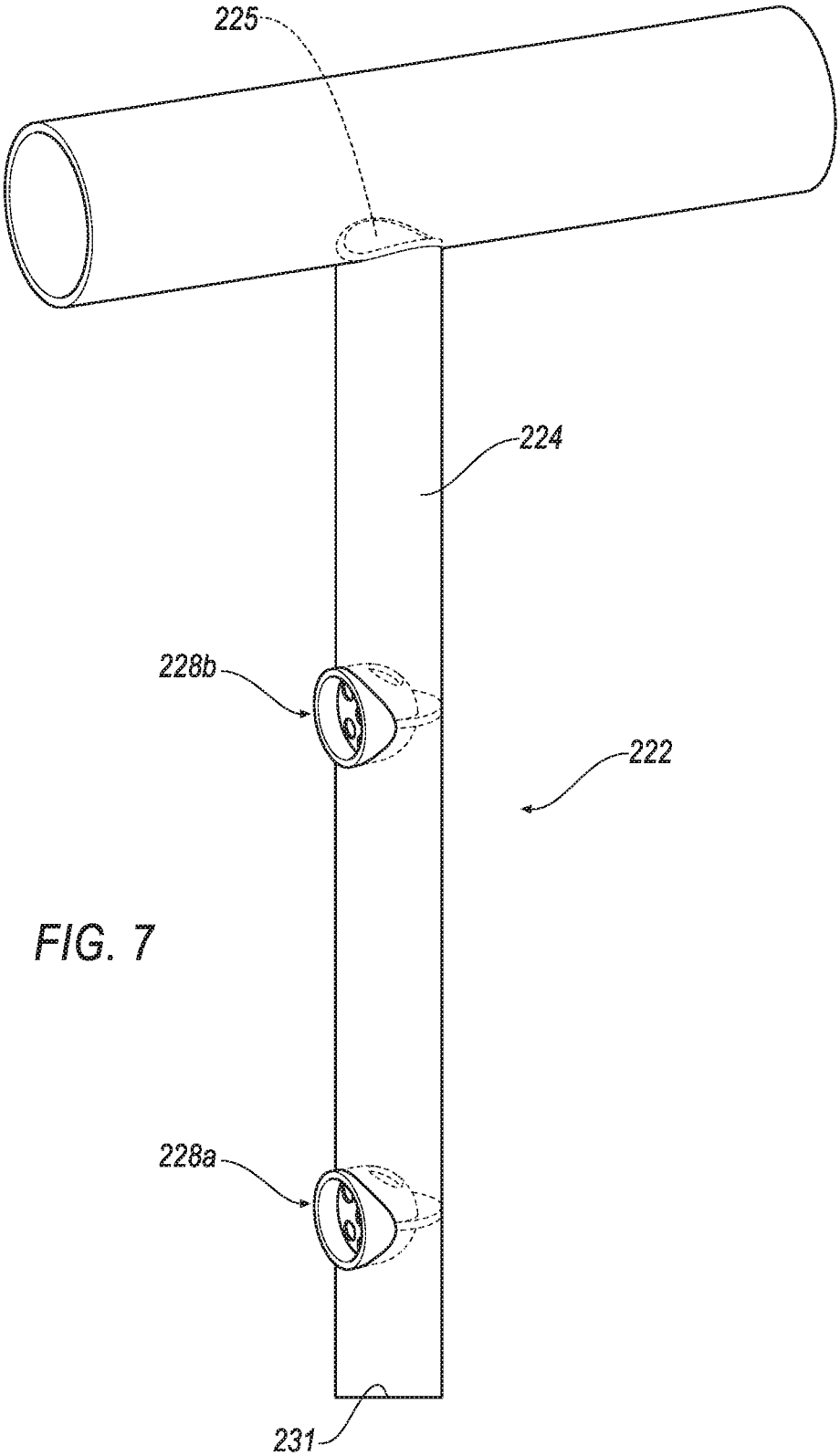
FIG. 7 is a perspective view of a third exemplary arrangement of a noise attenuation element.
Figure 8:
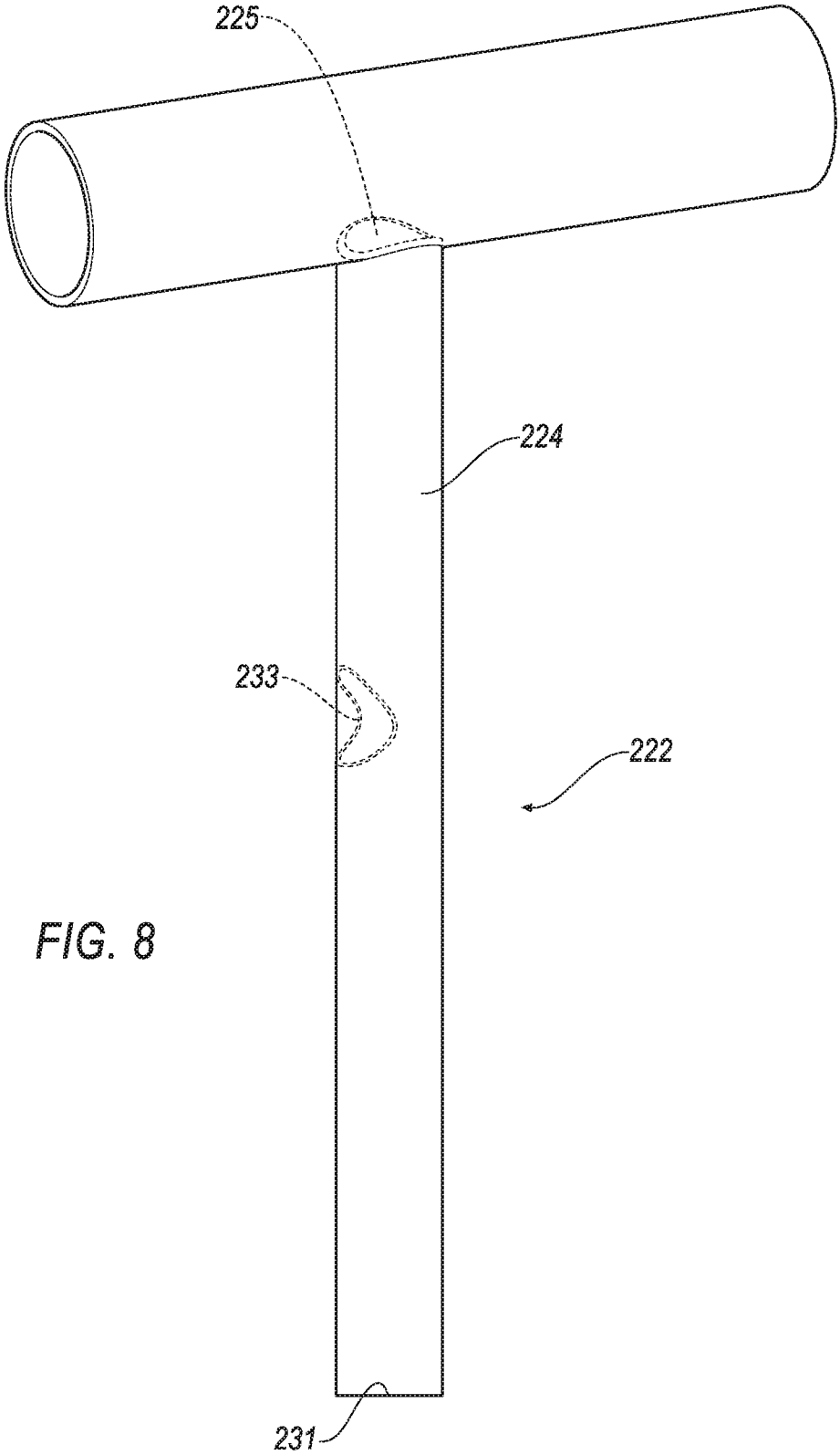
FIG. 8 is a perspective view of a quarter-wave tube of FIG. 7.

Referring to FIGS. 7-9, a further alternative arrangement of a noise attenuation device 222 may be seen. Noise attenuation device 222 is similar to noise attenuation device 22 and 122 except that noise attenuation device 222 a single quarter-wave tube 224 instead of a quarter-wave tube unit 24, 124 comprised of different tube\segments. Referring to FIG. 8, quarter-wave tube 224 having a predetermined effective length is provided. The quarter-wave tube 224 includes an open 225 and a closed end 231. In the noise attenuation device 222, the quarter-wave tube 224 may be provided at a preselected length for noise attenuation at a first preselected frequency. However, the quarter-wave tube 224 may be selectively modified to provide attenuation at a second frequency by cutting an opening into a sidewall of the quarter-wave tube 224 and seating one of the valves 228*a* therein.

More specifically, to selectively modify the effective length, at least one aperture 233 (shown in phantom in FIG. 8) may be formed in a sidewall of the quarter-wave tube 224. At least one valve member 228*a*/228*b* may be positioned within the respective aperture 233 formed within the quarter-wave tube 224.

Figure 9A:
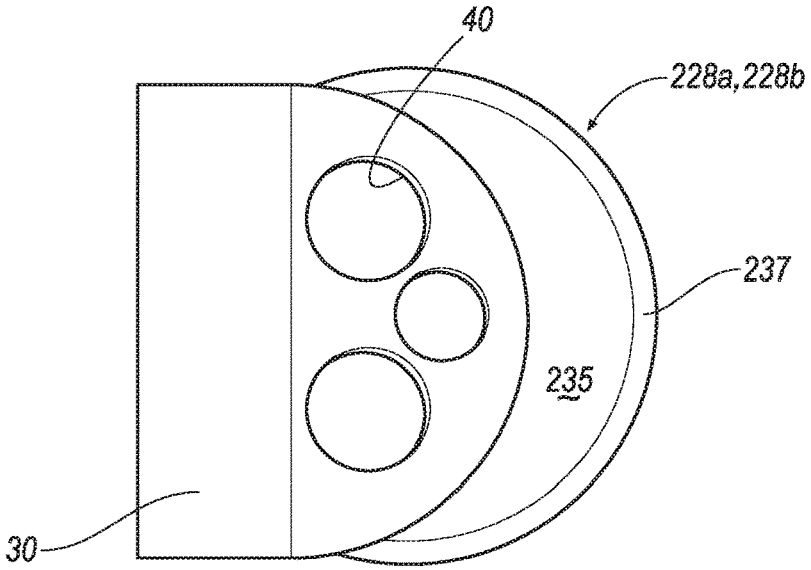
FIG. 9A is a plan view of the diaphragm valve of FIG. 7 in an open position.
Figure 9B:
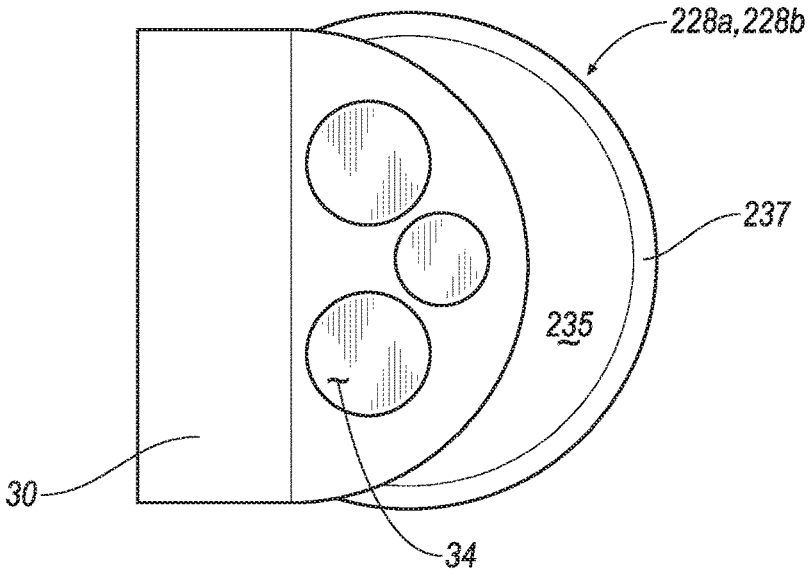
FIG. 9B is a plan view of the diaphragm valve of FIG. 7 in a closed position.

Valve members 228*a*-228*b* are similar in structure to valve members 28, 128 in that valve members 228*a*-228*b* each include an outer casing 30, a valve member 34, valve cover 32, and openings 40 through the outer casing 30. Referring to FIGS. 9A and 9B, when viewed in plan view, outer casing 30 further includes a sealing land 235 that may be at least partially bounded by a seal member 237. As shown in FIG. 7, after the aperture 233 is formed, valve member 228*a* or 228*b* is inserted therein, such that the outer casing 30 and the sealing land 235 selectively create a barrier within the quarter-wave tube 224.

For example, when the valve members 228*a*/228*b* are in their respective open position, shown in FIG. 9A respective valve members 34 are not covering the openings 40 in the outer casings 30. In this manner, the first effective length QW1 of the quarter-wave tube 224 is equal to the overall length of the quarter-wave tube 224. At the first effective length QW1, the noise attenuation element 222 will attenuate noise at a first predetermined peak frequency. It will be appreciated that the first predetermined peak frequency can be determined based on the known geometry of the quarter-wave tube 224.

However, when the valve members are in their respective closed positions, as shown in FIG. 9B, the effective length of the noise attenuation element 222 can be selectively reduced to second and third effective lengths, QW2-QW3, due to the valve member 34 being drawn against the inside surface of the outer casing 30 due to predetermined vacuum pressure to effectively close off the openings 40 within each of the outer casings 30, as explained above. With this arrangement, the noise attenuation device 122 may be selectively passively operated to attenuate at variable peak frequencies, but only using a single quarter-wave tube unit 124, eliminating the need for additional packaging space. Moreover, with this arrangement, and existing quarter-wave tube may be effectively modified or retrofitted to provide noise attenuation at different variable peak frequencies. FIG. 9 graphically illustrates the effectiveness of an embodiment of the noise attenuation device 122 as compared to a simple quarter-wave tube. For example, curve 50 illustrates the performance of a noise attenuation device configured as a simple quarter-wave tube, with no valve arrangement therein. At an approximately 145 Hz frequency, the simple quarter-wave tube will attenuate approximately 17 dB of sound pressure level (SPL), i.e., noise.

The noise attenuation device 122 is represented by line 52 in FIG. 9. More specifically, line 52 represents the performance of the noise attenuation device 122 with valves 128*a*, 128*b* each in the open configuration. As illustrated in FIG. 9, the effectiveness of the noise attenuation device 122 is similar to that of the simple quarter-wave tube. However, the valves 128*a* 128*b* also cause the quarter-wave tube unit 124 to act longer than it is. For example, at an approximately 130 Hz frequency, line 52 is performing as if the quarter-wave tube unit 124 is approximately 10 cm longer that the actual overall length. This permits attenuation of approximately 23 dB of noise at 130 Hz frequency.

Figure 10:
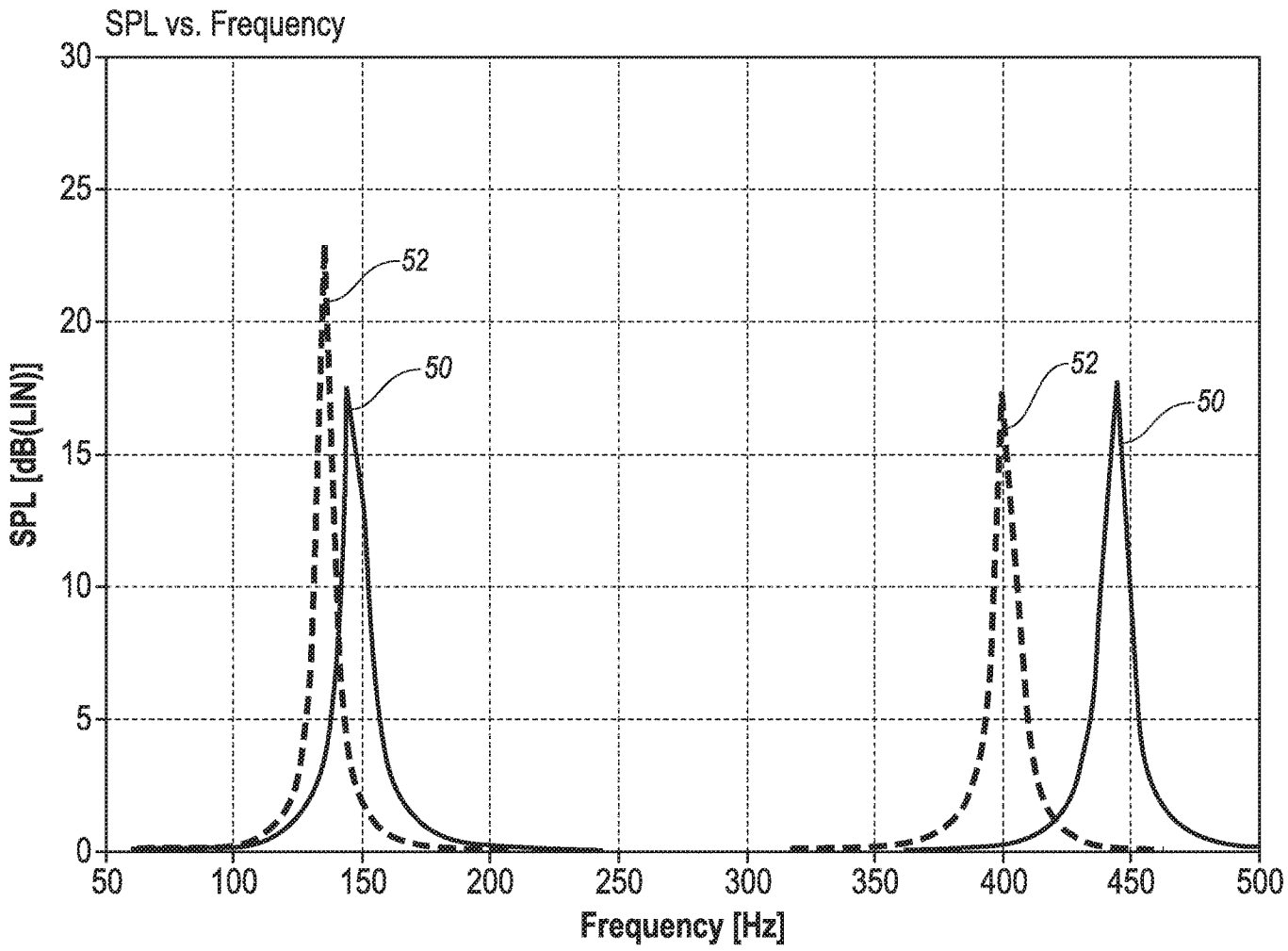
FIG. 10 is a graph illustrating the frequencies that may be achieved by the noise attenuation element of FIG. 2.
Figure 11:
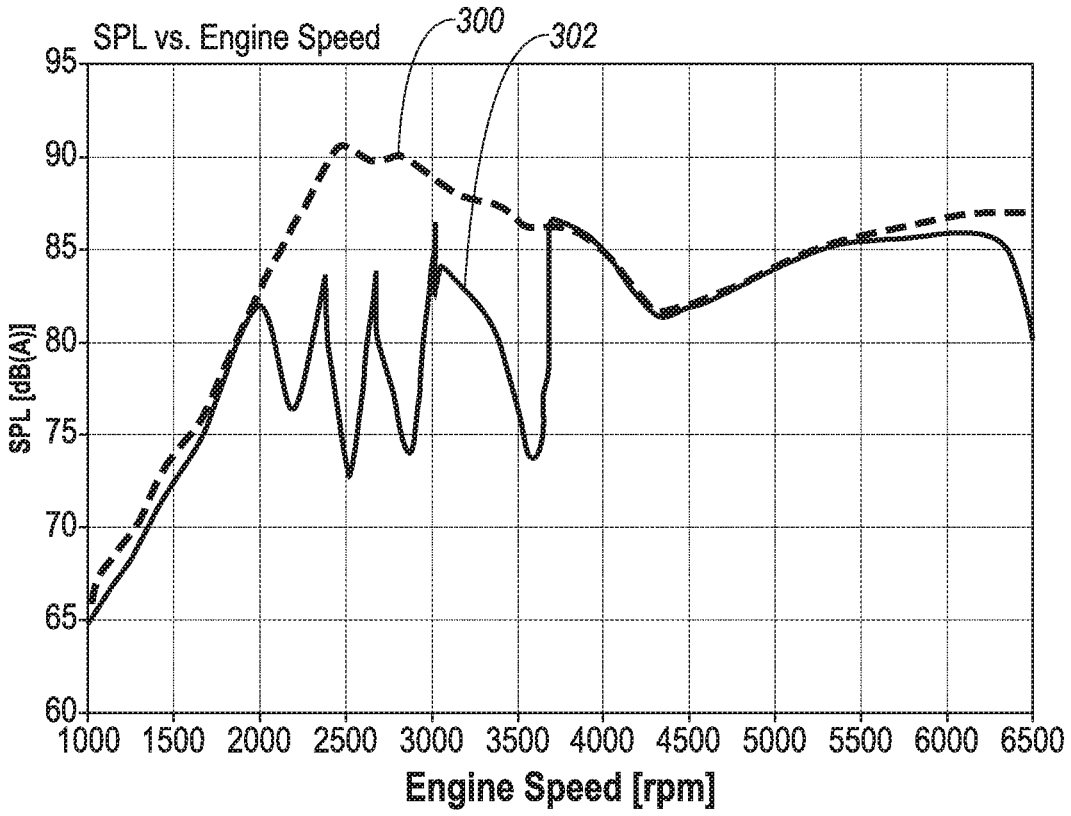
FIG. 11 is a graph illustrating sound pressure levels at various engine speeds that may be achieved with another exemplary arrangement of the noise attenuation element of FIG. 5, and without a quarter-wave resonator.

The effectiveness of the noise attenuation elements 22 and 122 will now be discussed in reference to the graph in FIG. 8. FIG. 10 demonstrates the attenuation characteristics without a quarter-wave resonator as compared with an embodiment of noise attenuation device 122 that has been tuned to 72 Hz (FIG. 6A), 84 Hz (FIG. 6B), 96 Hz (FIG. 6C), and 120 Hz. Curve 300 illustrates the sound pressure level (SPL) in decibels without a resonator. Curve 302 illustrates the SPL with the noise attenuation device 122. The noise attenuation device 122 serves to significantly reduce SPL. Further, as may be seen in the right of FIG. 8, the noise attenuation device 122 exhibits a third harmonic of the 72 Hz level at 218 Hz. Thus, the 3 different settings of the noise attenuation device 122 shown in FIGS. 6A-6C, is capable of yielding attenuation at 4 different frequencies. Thus the noise attenuation device 122 can be utilized to attenuate higher frequencies, as a quarter-wave tube 124 tuned below 100 Hz will attenuate 2 additional frequencies below 1000 Hz.

While exemplary embodiments are described above, it is not intended that these embodiments describe all possible forms of the invention. Rather, the words used in the specification are words of description rather than limitation, and it is understood that various changes may be made without departing from the spirit and scope of the invention. Additionally, the features of various implementing embodiments may be combined to form further embodiments of the invention.

What is claimed is:

1. A vehicle noise attenuation element, comprising:

a tube defining an overall length; and a valve including a valve member and openings that permit communication between sections of the tube when the valve is in an open configuration; the valve member closing the openings in response to a predetermined vacuum level within the sections of the tube to define a tube effective length that is less than the overall length.

2. The vehicle noise attenuation element of claim 1, wherein each of the sections of tube has a predefined length selected such that the predefined length and the overall length have associated desired peak attenuation frequencies selectable in response to the valve being in the open configuration or a closed configuration.

3. The vehicle noise attenuation element of claim 1, wherein the valve member further includes a sealing land that partially blocks a section of the tube.

4. A noise attenuation element for vehicles, comprising:

a tube unit defined by a plurality of tube sections, the tube unit having an overall length that defines a first effective length;

a first valve disposed between first and second tube sections; the first valve defined a first valve member and at least one first opening that permits communication between the first and second tube sections when the first valve is in an open configuration;

a second valve disposed between the second tube section and a third tube section; the second valve defined by second valve member and at least one second opening that permits communication between the second and third tube sections when the second valve member is in an open configuration; and wherein a first vacuum level within the tube unit serves to draw the first valve member against at least one first opening to move the first valve member into a closed configuration, to selectively define a second effective length of the tube unit that is less than the first effective length.

5. The noise attenuation element of claim 4, wherein the first valve member has a first spring factor coefficient that is different than a second spring factor coefficient of the second valve member.

6. The noise attenuation element of claim 5, wherein the first spring factor coefficient is less than the second spring factor coefficient.

7. The noise attenuation element of claim 4, wherein a second vacuum level within the tube unit serves to draw the second valve member against at least one of the second openings to move the second valve member into a closed configuration, to selectively define a third effective length of the tube unit that is less than the second effective length.

8. The noise attenuation element of claim 4, wherein the tube sections have different lengths.

9. The noise attenuation element of claim 4, wherein the tube sections have the same lengths and geometries.

* * * * *